US005291157A

United States Patent [19]

Riebman

[11] Patent Number: 5,291,157

[45] Date of Patent: Mar. 1, 1994

[54] LOW PARASITIC CAPACITANCE SUPERCONDUCTOR CIRCUIT NODE

[75] Inventor: Leon Riebman, Rydal, Pa.

[73] Assignee: AEL Defense Corp., Lansdale, Pa.

[21] Appl. No.: 980,939

[22] Filed: Nov. 20, 1992

[51] Int. Cl.[5] ..... H01P 5/02

[52] U.S. Cl. ..... 333/33; 333/246; 333/99 S; 505/703; 505/866

[58] Field of Search ..... 333/33, 238, 246, 99 S; 505/1, 700, 701, 866, 703

[56] References Cited

U.S. PATENT DOCUMENTS 3,451,015 6/1969 Heath ..... 333/246 X
4,837,536 6/1989 Honjo ..... 333/99 SX

FOREIGN PATENT DOCUMENTS 214601 10/1985 Japan ..... 333/246
246501 10/1990 Japan ..... 333/238
109801 5/1991 Japan ..... 333/238

*Primary Examiner*—Benny T. Lee
*Attorney, Agent, or Firm*—Seidel, Gonda, Lavorgna & Monaco

[57] ABSTRACT

Electronic circuit node structures which minimize parasitic capacitance in linear path and angular circuit topographies for high frequency circuits are described. The electronic circuit comprises at least two signal conductor elements and an active or passive circuit element on a substrate. The conductor elements are arranged to define a gap between their ends. The circuit element bridges the gap. In one embodiment, the longitudinal axes of the conductor elements are laterally offset and generally parallel. The conductors are arranged to form the gap between adjacent edges on the ends of the conductors. The circuit element is arranged to bridge the gap. The other conductor edges near the gap are arranged at angles which increase the distance between them. In another embodiment, the conductor elements form an angle with the gap at the apex. The circuit element bridges the gap between the conductor edges nearest the apex. Other conductor edges are arranged to form a line parallel to the axis of the circuit element. The angle defined by the intersection of the conductor elements may be between 90 and 150 degrees. In all embodiments, the circuit element and/or the conductor elements may be thin-film superconductors. In all embodiments, the circuit element may be placed on the same side of the substrate as the conductor elements, or it may be on the opposite side of the substrate, overlapping the conductor edges forming the gap.

11 Claims, 4 Drawing Sheets

PRIOR ART

LOW PARASITIC CAPACITANCE SUPERCONDUCTOR CIRCUIT NODE

FIELD OF THE INVENTION

The present invention pertains to the field of microwave and millimeter wave circuits employing microstrip signal conductor elements and incorporating superconducting circuit elements used as amplifiers, detectors, mixers, attenuators, switches, and frequency converters, for example.

BACKGROUND OF THE INVENTION

Unwanted capacitance at the connection between signal conductors and circuit elements has long been a phenomenon with which circuit designers have had to contend. Generally termed "parasitic" capacitance, it is commonly manifested as a capacitive effect between signal leads and the metal package of a circuit element, and as a capacitive effect across a circuit node caused by the disposition of two conductors in close proximity. Because capacitors can pass alternating current (AC) signals, parasitic capacitance of sufficient magnitude can both weaken signals and couple them into circuits where they are unwanted. The effects of parasitic capacitance cause signal degradation and limit the upper frequency at which a circuit can be operated.

Thin film device technology has reduced the phenomenon with respect to the capacitance which existed between input and output leads and element packages in a circuit node. But a residual parasitic effect remains in nodes where a thin film circuit element is connected between two microstrip conductors. The edges of the microstrip conductors nearest to the thin-film circuit element act as capacitive plates because the microstrip conductors are metal bodies of finite surface area separated by a small increment of distance across dielectric substances, i.e., air and the substrate upon which the conductors and the circuit element are deposited. The result is parasitic capacitance between the microstrip conductors and in parallel with the thin-film circuit element in the node.

In circuits where the thin-film circuit element and/or the conductor elements in the circuit node are superconductors, the combined effects of high signal frequencies and physically small circuit elements magnify the problem. Superconducting thin-film circuit elements are often non-linear devices whose resistive characteristics are controlled by varying bias currents passing through them. Parasitic capacitance is of little consequence when the superconducting circuit element is in its lowest resistance (i.e., superconducting) state, but becomes more significant and harmful to performance as the circuit element presents higher resistance to signals. In microwave and millimeter wave circuit nodes, parasitic capacitance is increasingly critical because of the inverse relation of impedance and frequency for capacitive circuits. Undesirable signal coupling across the circuit element connection is more pronounced and damaging at progressively higher frequencies.

The negative effects of parasitic capacitance are particularly significant in high frequency superconducting circuits. Because the input and output conductor segments are often superconductors, which by definition exhibit extremely low resistance, any capacitive coupling across an interface between conductor lines and a superconducting circuit element can cause serious signal degradation of leakage, depending on the application. Additionally, the physical length of superconducting circuit elements at millimeter wave frequencies can be on the order of 5 millimeters and less, making for very small dielectric gaps between the ends of the conductor elements between which the superconducting circuit element is connected. Thus, it is desirable to take measures to minimize the capacitance caused by the physical proximity of the input and output superconductors in a superconducting circuit node.

SUMMARY OF THE INVENTION

The present invention is an electronic circuit comprising at least first and second conductor elements arranged on a substrate with a circuit element. Each conductor element has a substantially elongated portion of constant width.

In one embodiment, the conductor elements each terminate in end portions having at least one edge defining an angle with reference to the longitudinal axis of the conductor element. The conductor elements are arranged to be essentially parallel and spaced apart. The conductor elements are arranged adjacent to one another and form a gap between their respective angled edges. The circuit element is arranged to bridge the gap between the edges of the conductor elements.

In one alternative embodiment, the end portions of the conductors terminate in at least two edges, angled with respect to each other and intersecting in a point. The respective first angled edges of the end portions of the first and second conductor elements are arranged parallel to each other, defining the gap between them. The circuit element is arranged in the gap. The respective second angled edges of the conductors are arranged generally parallel to the axis of the circuit element in the gap.

In another embodiment of the invention, the conductor elements are arranged such that their longitudinal axes intersect at an angle. The conductor means are arranged to form a gap between the respective first angled edges of their end portions at the apex of the angle of intersection. The circuit element is arranged in the gap. The angle of intersection of the conductor means may be between 90 and about 150 degrees.

Another embodiment of the invention begins with the conductor means intersecting at an angle as described above. In this embodiment the respective first angled edges of the end portions of the conductor means are arranged substantially parallel to each other across the gap. The second angled edges of the end portions of the conductor means are arranged substantially along a line parallel to an edge of the circuit element which connects the points at which the two angled edges of the end portions of the conductors intersect.

In all embodiments of the invention, the angled edges of the end portions of the conductor elements which define the gap may be arranged in parallel. When so arranged, the dimension of that angled edge of the conductor means is substantially equal to the width of the circuit element in the gap.

In all embodiments of the invention, either the conductor elements, the circuit element, or both may be thin-film superconductors.

In all embodiments of the invention, the circuit element may be located on the same side of the substrate as the conductor elements or on the opposite side. When on the same side of the substrate, the circuit element is connected to the respective edges of the conductor bounding the gap. When on the opposite side, the circuit element is arranged such that it overlaps the respective edges of the conductor elements bounding the gap.

BRIEF DESCRIPTION OF THE DRAWINGS

For the purpose of illustrating the invention, there are shown in the drawings forms which are presently preferred; it being understood, however, that this invention is not limited to the precise arrangements and embodiments shown.

DESCRIPTION OF THE INVENTION

Figure 1:
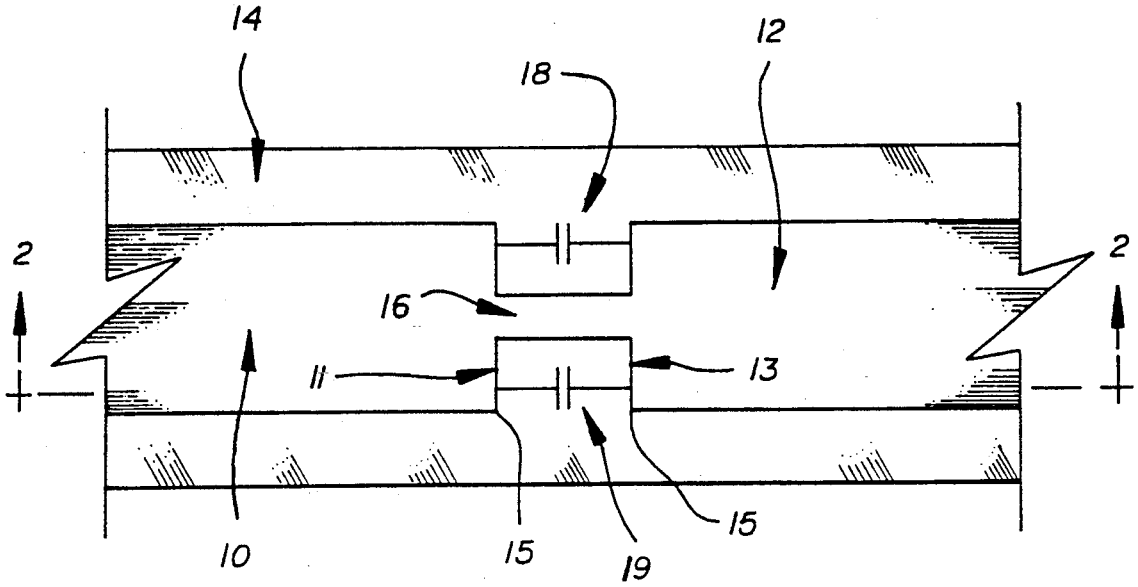
FIG. 1 PRIOR ART
FIG. 1 illustrates the typical superconducting circuit element connected between two conductor elements, according to the prior art.
Figure 2:
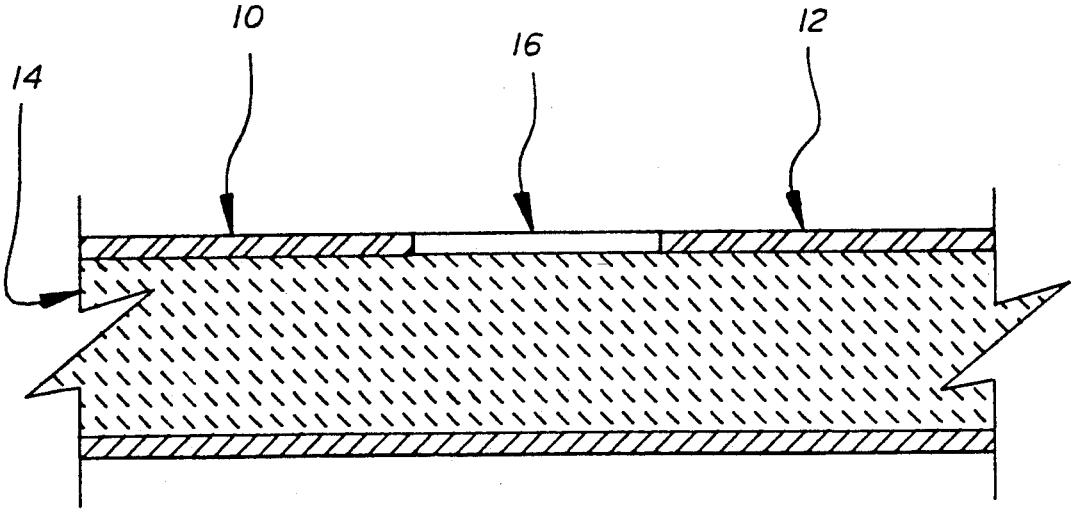
FIG. 2 is a cross-sectional view of the superconducting element and conductor elements according to the prior art, taken along the line A—A in FIG. 1.

Referring to the drawings, FIG. 1 is an illustration of a typical prior art superconducting circuit node used in microwave and millimeter wave transmission line circuits. A first signal conductor element 10 and second signal conductor element 12 are disposed on one planar surface of a dielectric substrate 14. The conductor elements 10, 12 may be, though they need not be, superconductors. A gap 15 exists between the conductor elements 10, 12 across which is disposed a superconducting circuit element 16. Circuit element 16 is preferably, although not necessarily, integral with the conductor elements 10, 12, completing the circuit node. FIG. 2 depicts the cross-sectional relation of the elements 10, 12, 14, 16 comprising this configuration.

It is a fundamental principle of physiscs familiar to these skilled in the art that any two circuit conductors in close proximity exhibit some capacitance across the gap between them. In the circuit of FIG. 1, two parallel capacitances 18, 19 are indicated in phantom in the gap 15 between the conductor line elements 10, 12. The capacitances 18, 19 are parasitic when they have a sufficiently high capacitive value to permit signal coupling across the gap 15 between the conductor line elements 10, 12, bypassing the circuit element 16. When the circuit element 16 is in the superconducting state, the coupling due to capacitance 18, 19 is of negligible magnitude and consequence because the impedance of the superconductor is essentially zero, and will be far less than the impedance presented by capacitances 18, 19. However, when the circuit element 16 is driven to a high resistive state by a bias circuit, or is permanently configured that way (i.e., for attenuation or impedance matching), signal coupling across the node caused by the parasitic capacitance is highly undesirable.

The well-known relation between frequency and impedance in capacitive circuits clearly indicates why the problem of parasitic capacitance is more serious in microwave and millimeter wave circuits. The mathematical relation defining the capacitive impedance of any circuit exhibiting parasitic capacitance $C_p$ is:

$$Z_c = \frac{1}{2\pi f C_p}$$

where $Z_c$ is the capacitive impedance and f is the frequency of the signal. Because the parasitic capacitance $C_p$ is determined by the physical relationship of the circuit components, it is constant. Because the relationship of $Z_c$ and f is inverse, an increase in the signal frequency decreases the capacitive impedance. The presence of high signal frequencies thus makes signal coupling across the node more likely. However, as a practical matter it is necessary and desirable to operate superconducting circuits at high frequencies. Therefore, f has to be regarded as a constant. The only way to increase the capacitive impedance of the node connection, thereby reducing parasitic signal coupling, is to reduce the only remaining variable in the relation, $C_p$.

It is well known in the art that the value of capacitance exhibited by parallel conductors disposed in close proximity, separated by dielectric materials such as silica substrates, mylar, glass or air, is defined as:

$$C = \frac{\epsilon_o A}{d}$$

where C is the value of capacitance, $\epsilon_o$ is the relative permittivity of the dielectric material, A is the area of the conductor surfaces, and d is the distance between them. Because $\epsilon_o$ is a constant for the dielectric material used, it can be observed that the capacitance of two conductors in proximity is a function of geometric traits, the area A of the conductors and the distance d separating them. The capacitance is directly related to the area of the conductors and inversely related to the separation distance. Referring again to FIG. 1, the conductor surfaces 11 and 13 exhibit parasitic capacitance 19 at high frequencies. The magnitude of parasitic capacitance 19 is a function of the surface area of conductor surfaces 11 and 13 and the distance which separates them. Thus, to decrease the inherent capacitance existing at a circuit node, the geometry of the node should minimize the total area of the conductors at their closest proximity and separate them by larger distances where possible.

The present invention permits constructing microwave and millimeter wave superconducting circuit element nodes with minimal parasitic capacitance. The invention permits constructing nodes with low parasitic capacitance both in circuits having substantially linear signal paths and those in which signal path direction changes up to 90 degrees. The invention limits the amount of surface area of the signal conductors in close proximity at the connection points of the superconducting circuit element in the node. The invention increases the distance between conductor surfaces not essential to the fabrication or function of the node. By controlling both geometric factors directly related to the value of the capacitance of the resulting node, the effect of parasitic capacitance is greatly reduced.

Figure 3:
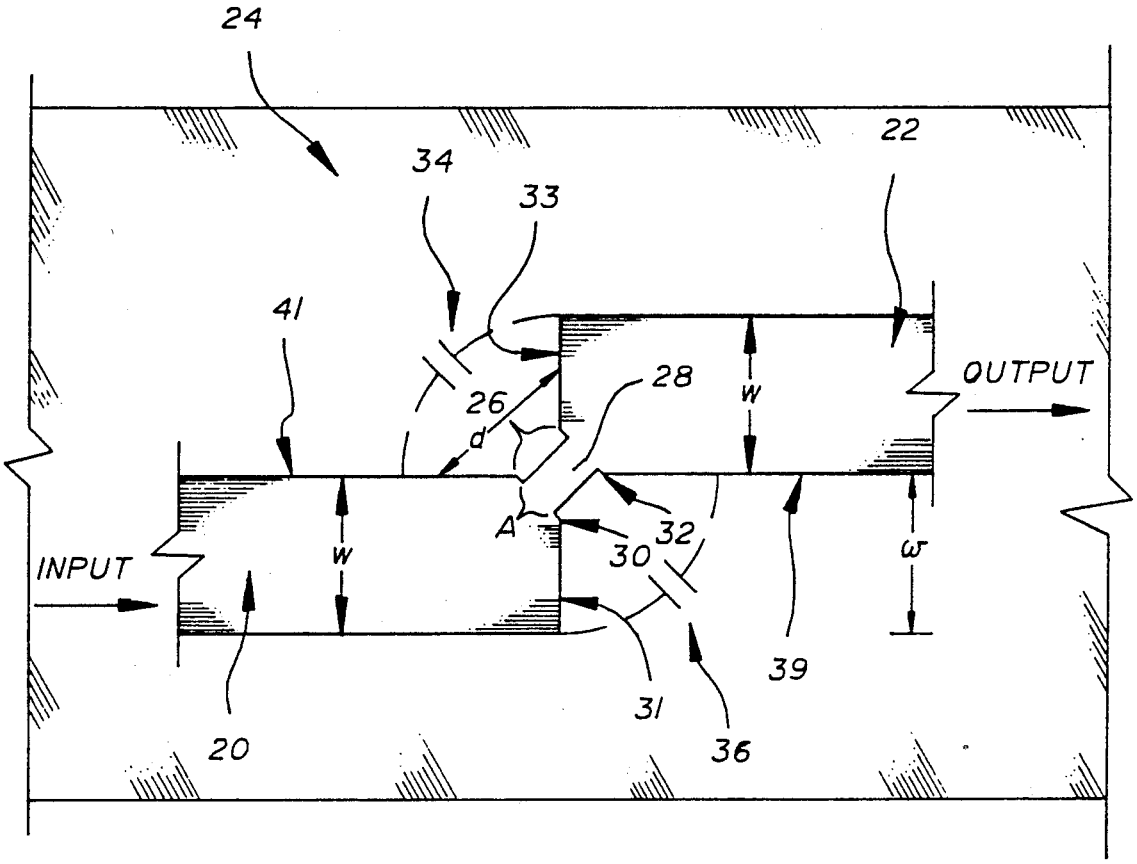
FIG. 3 is a top plan view of one embodiment of the present invention in which a generally linear signal path superconductor circuit node id depicted.

A superconducting circuit element node of a generally linear topography according to the invention is illustrated in FIG. 3. FIG. 3 shows first and second conductor elements 20, 22, the first element 20 representing the signal input path and second element 22 the signal output path, though they may be reversed depending upon the function of the circuit element in the node. Regardless of their form elsewhere in the electronic circuit, the conductor elements 20, 22 have elongated end portions of a width w bounding the circuit node. The conductor elements 20, 22 are disposed upon a dielectric substrate 24. Though they are arranged in a generally linear path, the conductor elements 20, 22 are laterally offset by a distance equal to at least the width, w, of the conductor elements 20, 22. Each conductor element 20, 22 has at its end two edges 30, 31 and 32, 33 angled with respect to each other and meeting at a single point on the end of the conductor element 20, 22. The precise sizes of the edges 30, 31 and 32, 33 and their particular angular relationship is a function of the width of a circuit element 28 and its position in a gap 26 between the conductors, as will be described further below.

As indicated in FIG. 3, the circuit element 28 is positioned in the gap 26 with its axis oriented at an angle of about 45 degrees to the longitudinal axes of the conductor elements 20, 22. This orientation is one factor which helps maximize the separation between the conductors 20, 22. The orientation of the axis of circuit element 28 also defines the angular relationship between the first and second angled edges 30, 31 and 32, 33 of the conductor end portions.

The gap 26 is left between the proximate edges 30, 32 of the ends of the conductor elements 20, 22. The circuit element 28, which can be, though it need not be, a superconductor is disposed between the conductor elements 20, 22 bridging the gap 26 between them.

The proximate edges 30, 32 of the conductor elements 20, 22 preferably provide parallel surfaces to which the circuit element 28 is connected. Parallel edges 30, 32 are substantially the same width as the circuit element 28. Any unnecessary exposed surface area of conductor line elements 20, 22 at this point of least distance between the two conductors increases the parasitic capacitance of the node.

The remaining capacitance in the node is modeled by the capacitors 34 and 36 shown in phantom in FIG. 3. The advantages of the node of the invention compared to the node of FIG. 1 are gained by the lateral offset between the conductor line elements 20, 22. The edges of the signal conductors 20, 22 bounding the gap 26 create the parasitic capacitance in the circuit node. Where the proximate edges 11, 13 of the conductor in FIG. 1 are the same small distance apart all across the gap between them, by contrast the distance between the edges 31, 39 and 33, 41 of the conductor elements 20, 22 in FIG. 3 increases rapidly at progressively larger distances from the location of the circuit element 28. This increased separation reduces the parasitic capacitances 34, 36 of the circuit node of the invention compared to the typical circuit node of FIG. 1.

In the circuit node of FIG. 3, the surface area A of the conductor edges 30, 32 in closest proximity is restricted to a minimum defined by the width of the circuit element 28. And the distance d between the other edges 31, 39 and 33, 41 of the conductor elements 20, 22 is rapidly increased as the edges recede from the location of the circuit element 28. Thus, in the structure of FIG. 3, the geometric factors which most directly affect the parasitic capacitance of the circuit node are controlled to minimize the generation of parasitic capacitance.

Figure 4:
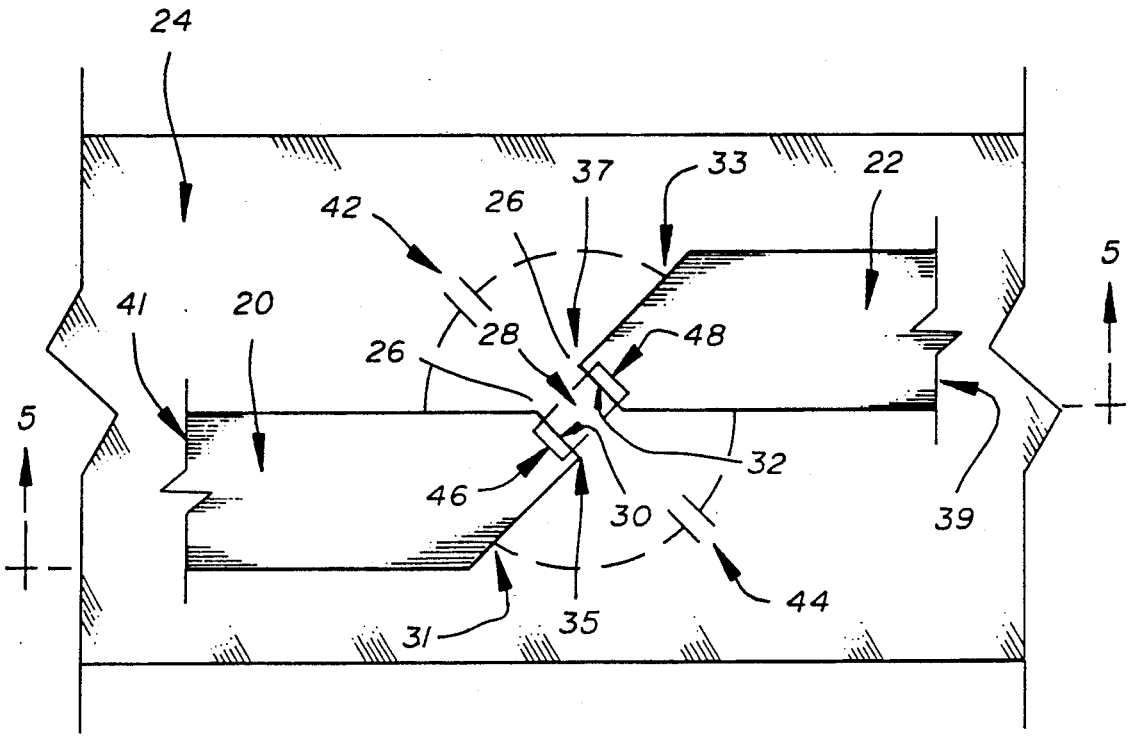
FIG. 4 illustrates an embodiment showing an alternative circuit node for superconducting circuit elements requiring DC isolation.
Figure 5:
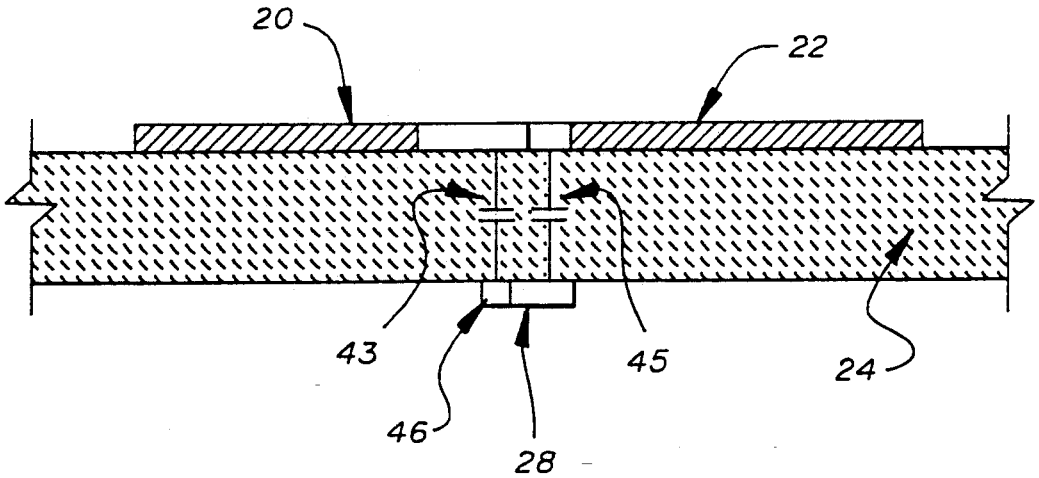
FIG. 5 is a side elevation view of the circuit node of FIG. 4.

An alternative embodiment of the invention is illustrated in FIGS. 4 and 5. In the circuit node of FIG. 4, the non-adjacent edges 31, 33 of the proximate ends of the conductor elements 20, 22 are angled sharply away from the location of the circuit node. Generally, the non-adjacent edges 31, 33 are arranged along parallel lines. Each line is parallel to the axis of the circuit element 28 disposed in the gap 26, and passes through the point 35, 37 at which the two angled edges 30, 31 and 32, 33 on the end of each conductor 20, 22 intersect. This directly reduces the parasitic capacitances 42, 44 shown in phantom in FIG. 4 by increasing the distance between the edges 31, 39 and 33, 41 where the capacitance 42, 44 exists. It should be noted that the arrangement of the non-adjacent edges 31, 33 detailed above and in FIG. 4 shows only one conveniently described alternative embodiment of the invention. Other embodiments are possible wherein the non-adjacent edges 31, 33 may be more or less sharply angled with respect to the other edges 30, 32 on the end of the conductor elements 20, 22. The magnitude of the angle required for limiting parasitic capacitance can depend on the signal frequency in the circuit or the size of the circuit element in the node. Generally, however, one object of the invention is to limit parasitic capacitance 42, 44 by increasing the distance between the edges 31, 39 and 33, 41 which manifest the capacitance.

Where conductor elements 20, 22 are superconductors, care must be taken not to narrow the segment of the conductor approaching the node to such a degree that the signal current density in the segment exceeds the critical current above which superconduction is not possible. When the critical current of a superconductor is exceeded, the resistance in the superconductor rises rapidly to normal levels, negating the superconducting characteristic. Therefore, the conductor edges should be arranged to increase the distance between them without adversely affecting the superconductive characteristic of the conductor line elements. Where the conductor elements 20, 22 are not superconductors, of course, no such concern is indicated and the edges can be shaped to increase the intervening distances as taught by the invention.

FIGS. 4 and 5 also show an embodiment of the invention whereby the circuit element 28 is disposed on the opposite planar surface of the dielectric substrate 24 from the conductor line elements 20, 22, as shown in phantom in FIG. 4, and in the side elevation view of FIG. 5. The depicted configuration is used when complete DC isolation of the circuit element 28 is required. Referring to FIG. 4, the input and output ends 46, 48 of the circuit element 28 are disposed to overlap the node edges 30, 32 of each of the conductor elements 20, 22. The signal is coupled into and out of the circuit element 28 using the capacitive relation thus created between the overlapped edges 30, 32 of the conductor elements 20, 22 and the input and output ends 46, 48 of the circuit element 28, indicated by the phantom capacitors 43, 45 in FIG. 5. The degree of overlap is only that which is necessary to result in a capacitance value for phantom capacitors 43 and 45 to present substantially zero impedance at the operating frequencies. If necessary, the thickness of substrate 24 may be varied to achieve the desired capacitance value. This disposition maintains the advantages of the node construction shown in FIG. 4 because the physical relation, and thus the parasitic capacitance, of the conductor line elements 20, 22 is not affected.

Figure 6:
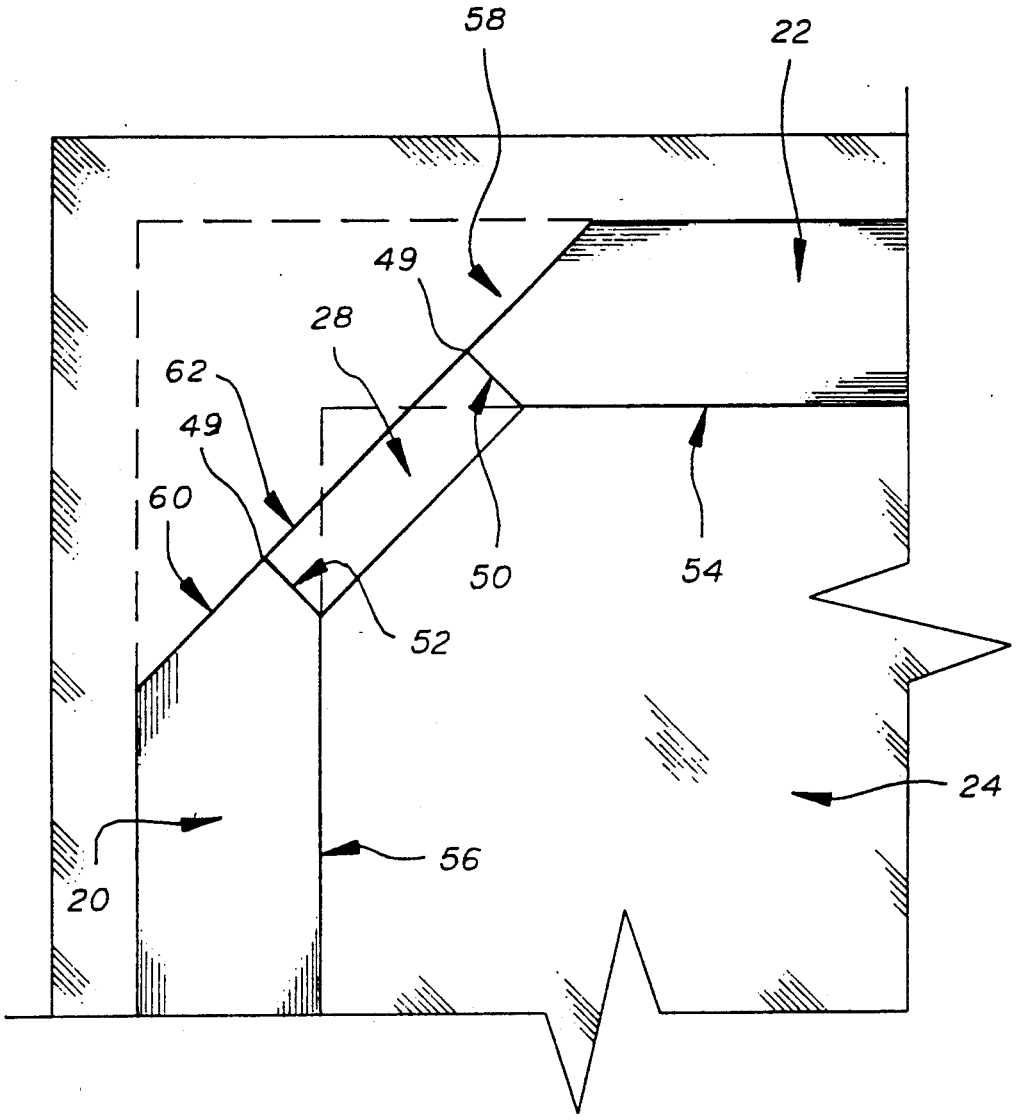
FIG. 6 is a top plan view of another embodiment of the superconductor circuit node, illustrating an angled signal path circuit node constructed according to the invention.

FIG. 6 illustrates a still further embodiment of the invention which comprises an angled circuit node; in this case about a 90 degree angle. As with the previous embodiments, two conductor elements 20, 22 arranged on a dielectric substrate 24 are the signal input and output paths respectively. Instead of meeting directly, as indicated by the phantom lines in FIG. 6, the conductor line elements 20, 22 terminate short of the apex of the angle. A gap 49 is created at the apex of the angle between the conductor elements 20, 22, having a dimension substantially the same as the length of the superconducting circuit element 28. The circuit element 28 is disposed across the gap 49 where the edges 50, 52 of the conductor elements 20, 22 are nearest each other. These edges 50, 52 of the conductor elements 20, 22 are usually, though not necessarily, parallel surfaces to which the circuit element 28 is connected by conventional means. The edges 50, 52 have substantially the same dimension as the width of the circuit element 28 when parallel to each other. Interposing the circuit element 28 between the conductor elements 20, 22 at the nearest edges 50, 52 prevents the creation of unnecessary adjacent facing edges between the conductor elements 20, 22. This arrangement creates only two facing edges 54, 56 in the interior angle of the angled node which recede rapidly from each other across a steadily increasing interval. The outer angled edges 58, 60 of the ends of the conductor elements 20, 22 are arranged to form a straight line along the edge 62 of the circuit element 28, achieving a large separation distance between these edges with a low parasitic capacitive effect.

Though FIG. 6 shows an angle between the conductor elements 20, 22 of about 90 degrees, the invention is not limited to 90 degree angles, but is useful for nodes comprising angles up to about 150 degrees (measured as the included angle between conductor elements 20, 22). For angles exceeding about 150 degrees, the method taught for the generally linear node is preferred because the angled node method would create long, narrowly angled conductor paths into and out of the node. This result could threaten the superconductive characteristic of the conductor elements by causing the critical current in them to be exceeded.

Though not shown in the drawings, the circuit element 28 in the angled node of FIG. 6 can be disposed on the opposite planar surface of the substrate 24 for DC isolation, just as in the generally linear node of FIGS. 4 and 5. If that is done, it may be necessary to arrange the proximate edges 50, 52 of the conductor line elements 20, 22 closer to each other to facilitate the overlap with the input and output ends of the circuit element 28. Alternatively, the circuit element 28 might be provided with extended leads to facilitate the overlap without decreasing the separation distance between the conductor edges 50, 52.

The present invention may be embodied in other specific forms without departing from the spirit or essential attributes thereof and, accordingly, reference should be made to the appended claims, rather than to the foregoing specification, as indicating the scope of the invention.

I claim:

1. An electronic circuit comprising first and second signal conductor means arranged on a substrate with a circuit element having a preselected length and width, said first and second conductor means each having a substantially elongated portion of constant width w along a respective longitudinal axis, the elongated portions of each signal conductor means terminating in a respective end portion having first and second angled edges, the respective longitudinal axes of the first and second signal conductor means being further arranged substantially parallel to each other and separated by a distance substantially equal to the width w of the elongated portion of the first and second conductor means;

the end portions of the first and second conductor means being further arranged to define a gap between the respective first angled edges of the end portions of the respective conductor means, said gap having a dimension substantially equal to the length of the circuit element, said circuit element being electrically connected across the gap between the first angled edges of the end portions of the first and second conductor means.

2. The electronic circuit of claim 1, wherein the second angled edge of the respective end portions of the first and second conductor means lying substantially along a line which extends away from the gap between the respective first angled edges of the respective end portions at an angle not exceeding 90 degrees with respect to the longitudinal axis of the respective conductor means, said second angled edge facing away from the respective conductor means.

3. The electronic circuit of claim 1, wherein the first and second conductor means are thin-film superconductors.

4. The electronic circuit of claim 1 or 3, wherein the circuit element is a thin-film superconductor.

5. An electronic circuit comprising a first and second conductor means arranged on a substrate with a circuit element of preselected length and width;

said first and second conductor means each having a substantially elongated portion having a respective longitudinal axis and terminating in a respective end portion having first and second angled edges, said respective first and second angled edges being arranged to intersect at a respective point, the longitudinal axes of the first and second conductor means being arranged to intersect at an angle, said angle being at least 90 degrees and less than 180 degrees, the end portions of the first and second conductor means being further arranged to define a gap between the respective first angled edges of the end portions of the respective conductor means, said gap having a dimension substantially equal to the length of the circuit element, the circuit element being electrically connected across the gap between the first and second conductor means, wherein the second angled edge of the respective end portions of the first and second conductor means lies substantially along a line which extends away from the gap between the respective first angled edges of the respective end portions at an angle not exceeding 90 degrees with respect to the longitudinal axis of the respective conductor means, said second angled edge facing away from the respective conductor means.

6. The electronic circuit of claim 5, wherein the angle of intersection of the longitudinal axes of the first and second conductor means is between 90 degrees and about 150 degrees.

7. The electronic circuit of claim 5, wherein the first and second conductor means are superconductors.

8. The electronic circuit of claim 5 or 7, wherein the circuit element is a thin-film superconductor.

9. The electronic circuit of claim 1 or 5, wherein the substrate comprises first and second planar surfaces, and the circuit element is disposed on one of the first and second planar surfaces of the substrate and the conductor means is disposed on the other of said first and second planar surfaces of the substrate, and wherein said first angled edges of the conductor means overlap ends of the circuit element.

10. The electronic circuit of claim 1 or 5, wherein the substrate comprises first and second planar surfaces, and the circuit element is disposed on the same planar surface of the substrate as the first and second conductor means and is connected to the respective first angled edges of the end portions of the first and second conductor means.

11. The electronic circuit of claim 1 or 5, wherein the respective first angled edges of the end portions of the conductor means are substantially parallel, and said parallel first angled edges each have a dimension substantially equal to the width of the circuit element.

* * * * *